US012196080B2

(12) United States Patent
Song et al.

(10) Patent No.: US 12,196,080 B2
(45) Date of Patent: Jan. 14, 2025

(54) DRILLING DEVICE FOR GEOTECHNICAL ENGINEERING INVESTIGATION

(71) Applicant: Guilin University of Technology, Guilin (CN)

(72) Inventors: Yu Song, Guilin (CN); Mingzhi Zhang, Guilin (CN); Jun Li, Guilin (CN); Xiaohui Gan, Guilin (CN); Hui Li, Guilin (CN); Jianqiang Wang, Guilin (CN); Yukun Geng, Guilin (CN); Shuaishuai Dong, Guilin (CN); Song Ding, Guilin (CN)

(73) Assignee: Guilin University of Technology, Guilin (CN)

( * ) Notice: Subject to any disclaimer, the term of this patent is extended or adjusted under 35 U.S.C. 154(b) by 4 days.

(21) Appl. No.: 18/331,254

(22) Filed: Jun. 8, 2023

(65) Prior Publication Data

US 2023/0313615 A1 Oct. 5, 2023

Related U.S. Application Data

(63) Continuation of application No. PCT/CN2022/125916, filed on Oct. 18, 2022.

(30) Foreign Application Priority Data

Jan. 26, 2022 (CN) ..... 202210093158.2

(51) Int. Cl.
*E21B 7/02* (2006.01)

(52) U.S. Cl.
CPC ..... *E21B 7/027* (2013.01)

(58) Field of Classification Search
CPC . E21B 7/02; E21B 7/027; E21B 15/00; E21B 49/02; E02B 13/04
See application file for complete search history.

(56) References Cited

U.S. PATENT DOCUMENTS

| | | | | |
|---|---|---|---|---|
| 11,220,800 | B2 * | 1/2022 | Lebon | E02D 13/00 |
| 2014/0238747 | A1 * | 8/2014 | Fabian | F16M 11/00 175/57 |

(Continued)

FOREIGN PATENT DOCUMENTS

| | | | |
|---|---|---|---|
| CN | 207212268 U | | 4/2018 |
| CN | 210829096 U | * | 6/2020 |
| CN | 212337176 U | | 1/2021 |

(Continued)

*Primary Examiner* — Jennifer H Gay

(57) ABSTRACT

A drilling device for geotechnical engineering investigation is provided, including an outer supporting ring seat, where a center of the outer supporting ring seat is rotatably connected with a middle supporting ring seat through a first supporting shaft rod; a center of the middle supporting ring seat is rotatably connected with an inner supporting ring seat through a second supporting shaft rod; the first supporting shaft rod and the second supporting shaft rod are vertically crossed; a second rotating motor is fixedly installed at one end of the first supporting shaft rod on an outer surface of the outer supporting ring seat; a pow output end of the second rotating motor is fixedly connected with the first supporting shaft rod, an other end of the first supporting shaft rod is provided with a first locking mechanism for position limitation.

10 Claims, 8 Drawing Sheets

(56) References Cited

U.S. PATENT DOCUMENTS

| | | | | |
|---|---|---|---|---|
| 2021/0123202 | A1* | 4/2021 | Lebon | E02D 13/00 |
| 2023/0313615 | A1* | 10/2023 | Song | E21B 7/027 |

FOREIGN PATENT DOCUMENTS

| | | | | | |
|---|---|---|---|---|---|
| CN | 112324355 | A | | 2/2021 | |
| CN | 113250615 | A | * | 8/2021 | |
| CN | 113863869 | A | * | 12/2021 | E21B 15/00 |
| CN | 114482859 | A | | 5/2022 | |
| CN | 117432334 | A | * | 1/2024 | |
| CN | 117927139 | A | * | 4/2024 | |
| CN | 118029915 | A | * | 5/2024 | |
| RU | 2401376 | C1 | | 10/2010 | |

* cited by examiner

DRILLING DEVICE FOR GEOTECHNICAL ENGINEERING INVESTIGATION

CROSS-REFERENCE TO RELATED APPLICATIONS

This application is a continuation of PCT/CN2022/125916, filed on Oct. 18, 2022, which claims priority to Chinese Patent Application No. 202210093158 2, filed on Jan. 26, 2022, the contents of which are hereby incorporated by reference.

TECHNICAL FIELD

The application relates to the technical field of geotechnical engineering investigation, and in particular to a drilling device for geotechnical engineering investigation.

BACKGROUND

Geotechnical engineering investigation refers to the activity of identifying, analyzing and evaluating the geological and environmental characteristics and geotechnical engineering conditions of the construction site and compiling investigation documents according to the requirements of construction projects. Main purposes of geotechnical engineering investigation are to investigate, analyze and judge the construction site by testing means and methods, to study the geological conditions of various engineering buildings and the influence of construction on the natural geological environment, to study the measures to ensure the strength and stability of foundation and prevent the foundation from impermissible deformation when the foundation, foundation structure and superstructure work jointly, and to improve the bearing capacity of foundation, and provide the engineering address and geotechnical information needed for foundation design and construction and foundation reinforcement when necessary.

However, the existing drilling devices, such as a drilling device for geotechnical investigation and drilling technology with publication number of CN113738267A, basically limit the drill pipe in the vertical direction, so that a stable drilling state is maintained. However, in the actual drilling process, there are many situations where inclined drilling is needed, so this drilling device cannot work and has a small range of application.

SUMMARY

Aiming at the problems existing in the prior art, the objective of the application is to provide a drilling device for geotechnical engineering investigation, and the drilling device for geotechnical engineering investigation is able to realize multi-angle position limitation of a drill pipe and limit the drill pipe at a designated drilling position at the same time, and is applicable for various drilling situations, wide in application range and convenient to popularize.

In order to solve the above problems, the application adopts the following technical scheme.

A drilling device for geotechnical engineering investigation includes an outer supporting ring seat, where a center of the outer supporting ring seat is rotatably connected with a middle supporting ring seat through a first supporting shaft rod; a center of the middle supporting ring seat is rotatably connected with an inner supporting ring seat through a second supporting shaft rod; the first supporting shaft rod and the second supporting shaft rod are vertically crossed; a second rotating motor is fixedly installed at one end of the first supporting shaft rod on an outer surface of the outer supporting ring seat; a pow output end of the second rotating motor is fixedly connected with the first supporting shaft rod, an other end of the first supporting shaft rod is provided with a first locking mechanism for position limitation; a first rotating motor is fixedly installed at one end of the second supporting shaft rod on an outer surface of the middle supporting ring seat, a power output end of the first rotating motor is fixedly connected with the second supporting shaft rod, and an other end of the second supporting shaft rod is also provided with a second locking mechanism for position limitation. A drill pipe limit seat is fixedly installed right above the inner supporting ring seat through a bracket, a drilling drive device is arranged right above the drill pipe limit seat, and a connecting support seat is fixedly installed at a power output end of the drilling drive device. A drill pipe is fixedly installed at a bottom end of the connecting support seat, a bottom end of the drill pipe is rotatably connected inside the drill pipe limit seat, a drainage mechanism for discharging liquid inside rocks is arranged inside the drill pipe. A buffering mechanism for buffering and supporting the drilling drive device is arranged between the connecting support seat and the outer supporting ring seat, and a bottom surface of the outer supporting ring seat is provided with a bottom supporting mechanism fixedly connected with a ground.

Optionally, the buffering mechanism includes side supporting arms fixedly welded to the outer surface of the outer supporting ring seat and second universal ball shafts rotatably connected to an outer surface of the connecting support seat; a top surface of each of the side supporting arms is provided with a chute; a slider is slidably connected inside the chute; a top surface of the slider is rotatably connected with a first universal ball shaft; a supporting hydraulic rod is arranged between the first universal ball shaft and corresponding one of the second universal ball shafts; and one end of the supporting hydraulic rod is rotatably connected with the first universal ball shaft and an other end of the supporting hydraulic rod is rotatably connected with the corresponding one of the second universal ball shafts.

Optionally, the side supporting arms are provided at least four and are uniformly circumferentially arrayed on the outer surface of the outer supporting ring seat, and a number of the second universal ball shafts is the same as that of the side supporting arms, and positions of the second universal ball shafts and the corresponding side supporting arms are matched.

Optionally, a damping sliding shaft is arranged between the slider and the chute.

Optionally, the bottom supporting mechanism includes mounting support seats arranged on a bottom surfaces of each joint of the each of the side supporting arms and the outer supporting ring seat, where a bottom end of each of the mounting support seats is rotatably connected with a movable leg, a bottom end of the movable leg are rotatably connected with a grounding leg, and a bottom surface of the grounding leg is provided with a fixing nail.

Optionally, a top connecting seat is fixedly welded at one end of a bottom surface of the each of the side supporting arms away from the inner supporting ring seat, a bottom connecting seat is fixedly welded at a center of a top surface of the movable leg, and a buffering hydraulic rod is arranged between the bottom connecting seat and the top connecting seat, where one end of the buffering hydraulic rod is rotatably connected to the bottom connecting seat, and an other end of the buffering hydraulic rod is rotatably connected to the top connecting seat.

Optionally, the first locking mechanism and the second locking mechanism both include supporting shells fixedly installed on the outer surface of the outer supporting ring seat and an outer surface of the middle supporting ring seat; brake gears are arranged in the supporting shells; the brake gears are fixedly sleeved ends of the first supporting shaft rod and the second supporting shaft rod respectively; a brake strut is rotatably connected at one corner of a top end of the each of the supporting shells; a brake chuck is arranged on a bottom surface of one end of the brake strut adjacent to a top surface of each of the brake gears; a brake cylinder is fixedly installed at one end of the each of the supporting shells adjacent to a rotating shaft of the brake strut; and a pow output end of the brake cylinder is rotatably connected with a bottom end of the brake strut.

Optionally, the drainage mechanism includes water inlet holes arranged on a side of the bottom end of the drill pipe and a drainage hollow groove arranged inside the drill pipe, and a water outlet is arranged on a side of a top end of the drill pipe, and the water outlet is communicated with the drainage hollow groove.

Optionally, the water outlet is connected with a water pumping device through a universal hose.

Optionally, two sides of a bottom end of the drilling drive device are symmetrically provided with handles.

The present application has following beneficial effects.

Firstly, the mutual cooperation among the outer supporting ring seat, the middle supporting ring seat and the inner supporting ring seat enables the drill pipe to rotate at any angle in a three-dimensional space according to needs and the need for inclined drilling in most situations is further satisfied. Moreover, vertical drilling is also realized, which provides a wider range of application and diversifies the drilling methods, therefore contributing to popularization.

Secondly, with the first locking mechanism and the second locking mechanism, the rotating positions of the first supporting shaft rod and the second supporting shaft rod are locked after the drill pipe is positionally adjusted, thereby avoiding position deviation caused by excessive impact force during drilling, and avoiding damage to the first rotating motor and the second rotating motor at the same time, thus making the drilling process more stable and reliable.

Thirdly, the buffer mechanism adaptively adjusts the position while the drill pipe is positionally adjusted, and stably supports the drill pipe and the drilling drive device, so that the control of the device by the staff during drilling is more convenient and the drilling process is more stable.

Lastly, the bottom supporting mechanism forms a stable triangular structure to support the drilling device for geotechnical engineering investigation, and meanwhile, the drilling impact force is buffered in the drilling process, thus reducing the damage to the drilling device for geotechnical engineering investigation during working while stable support is provided and prolonging the service life of the drilling device for geotechnical engineering investigation.

DETAILED DESCRIPTION OF THE EMBODIMENTS

Figure 1:
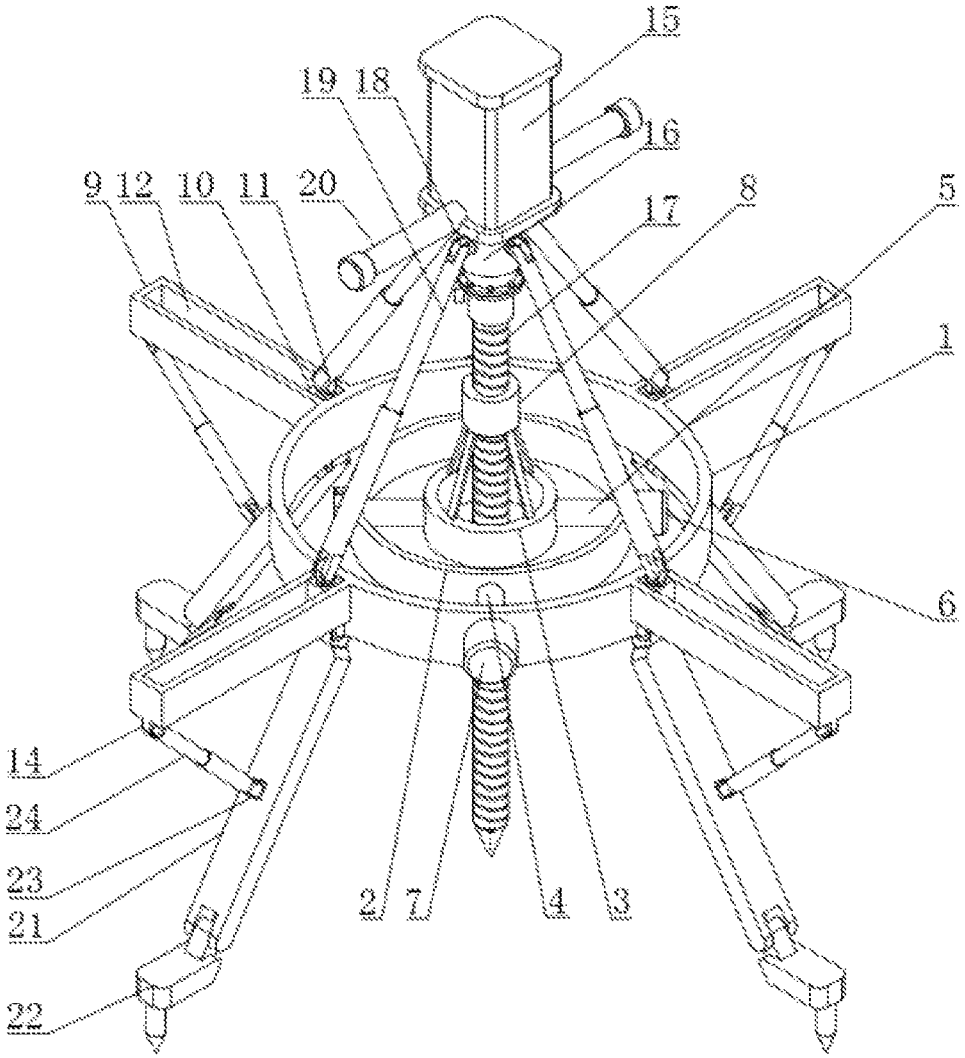
FIG. 1 is a schematic diagram of the three-dimensional structure of the present application.

In the following, the technical scheme in the embodiment of the application will be described clearly and completely with the attached drawings. Obviously, the described embodiment is only a part of the embodiment of the present application, but not all the embodiments. Based on the embodiment in the present application, all other embodiments obtained by ordinary people in the field without creative labor belong to the scope of protection of the present application.

EMBODIMENT

With reference to FIG. 1-FIG. 8, a drilling device for geotechnical engineering investigation includes an outer supporting ring seat 1, where a center of the outer supporting ring seat 1 is rotatably connected with a middle supporting ring seat 2 through a first supporting shaft rod 4; a center of the middle supporting ring seat 2 is rotatably connected with an inner supporting ring seat 3 through a second supporting shaft rod 5; the first supporting shaft rod 4 and the second supporting shaft rod 5 are vertically crossed; a second rotating motor 7 is fixedly installed at one end of the first supporting shaft rod 4 on an outer surface of the outer supporting ring seat 1; a pow output end of the second rotating motor 7 is fixedly connected with the first supporting shaft rod 4, an other end of the first supporting shaft rod 4 is provided with a first locking mechanism for position limitation; a first rotating motor 6 is fixedly installed at one end of the second supporting shaft rod 5 on an outer surface of the middle supporting ring seat 2, a power output end of the first rotating motor 6 is fixedly connected with the second supporting shaft rod 5, and an other end of the second supporting shaft rod 5 is also provided with a second locking mechanism for position limitation. A drill pipe limit seat 8 is fixedly installed right above the inner supporting ring seat 3 through a bracket, a drilling drive device 15 is arranged right above the drill pipe limit seat 8, and a connecting support seat 16 is fixedly installed at a power output end of the drilling drive device 15. A drill pipe 17 is fixedly installed at a bottom end of the connecting support seat 16, a bottom end of the drill pipe 17 is rotatably connected inside the drill pipe limit seat 8, a drainage mechanism for discharging liquid inside rocks is arranged inside the drill pipe 17. A buffering mechanism for buffering and supporting the drilling drive device 15 is arranged between the connecting support seat 16 and the outer supporting ring seat 1, and a bottom surface of the outer supporting ring seat 1 is provided with a bottom supporting mechanism fixedly connected with a ground.

With reference to FIG. 1-FIG. 6, the buffering mechanism includes side supporting arms 9 fixedly welded to the outer surface of the outer supporting ring seat 1 and second universal ball shafts 18 rotatably connected to an outer surface of the connecting support seat 16; a top surface of each of the side supporting arms 9 is provided with a chute 12; a slider 10 is slidably connected inside the chute 12. A top surface of the slider 10 is rotatably connected with a first universal ball shaft 11; a supporting hydraulic rod 19 is arranged between the first universal ball shaft 11 and corresponding one of the second universal ball shafts 18 and one end of the supporting hydraulic rod 19 is rotatably connected with the first universal ball shaft 11 and an other end of the supporting hydraulic rod 19 is rotatably connected with the corresponding one of the second universal ball shafts 18. Therefore, the supporting hydraulic rod 19 at different positions are able to adaptively retract and rotate with the change of the angle of the drill pipe 17 and the stable supporting effect is further provided.

With reference to FIG. 1-FIG. 6, the side supporting arms 9 are provided at least four. In this embodiment, the side supporting arms are provided with four and are uniformly circumferentially arrayed on the outer surface of the outer supporting ring seat 1. A number of the second universal ball shafts 18 is the same as that of the side supporting arms 9, and positions of the second universal ball shafts 18 and the corresponding side supporting arms 9 are matched, which facilitates the drilling drive device 15 to be buffered and supported in all directions and further helps the staff to control the drilling drive device 15 and a situation where the excessive weight of the drilling drive device 15 leads to the failure in controlling the drilling drive device 15 by the staff is avoided.

Figure 2:
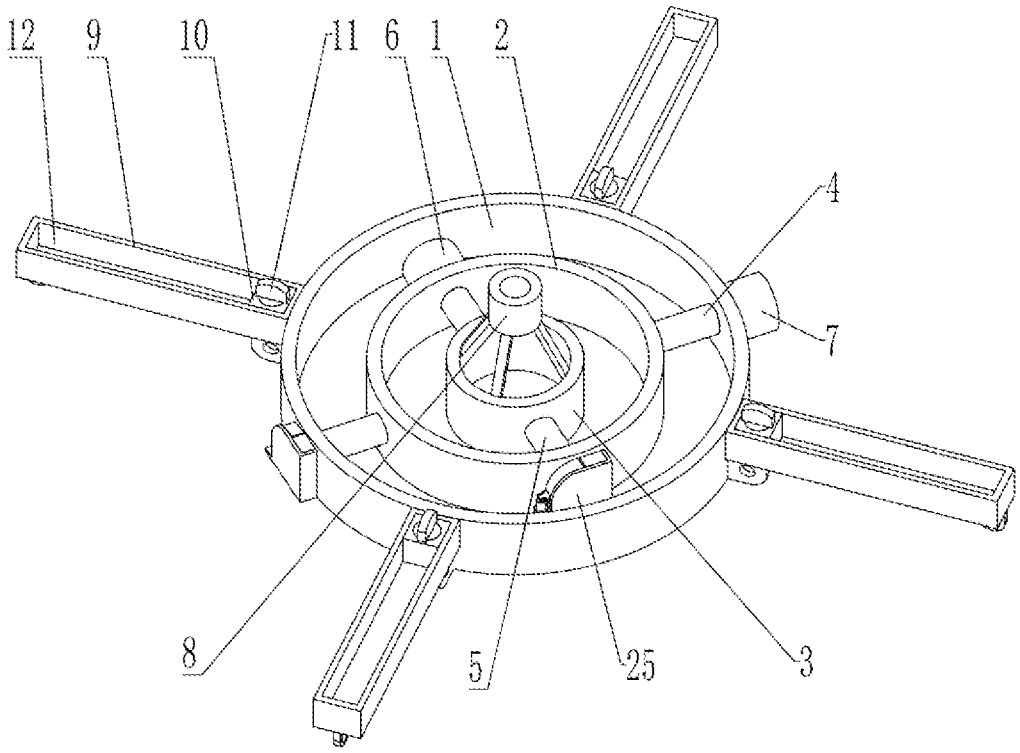
FIG. 2 is a schematic structural diagram of a top surface of an outer supporting ring seat of the present application.
Figure 3:
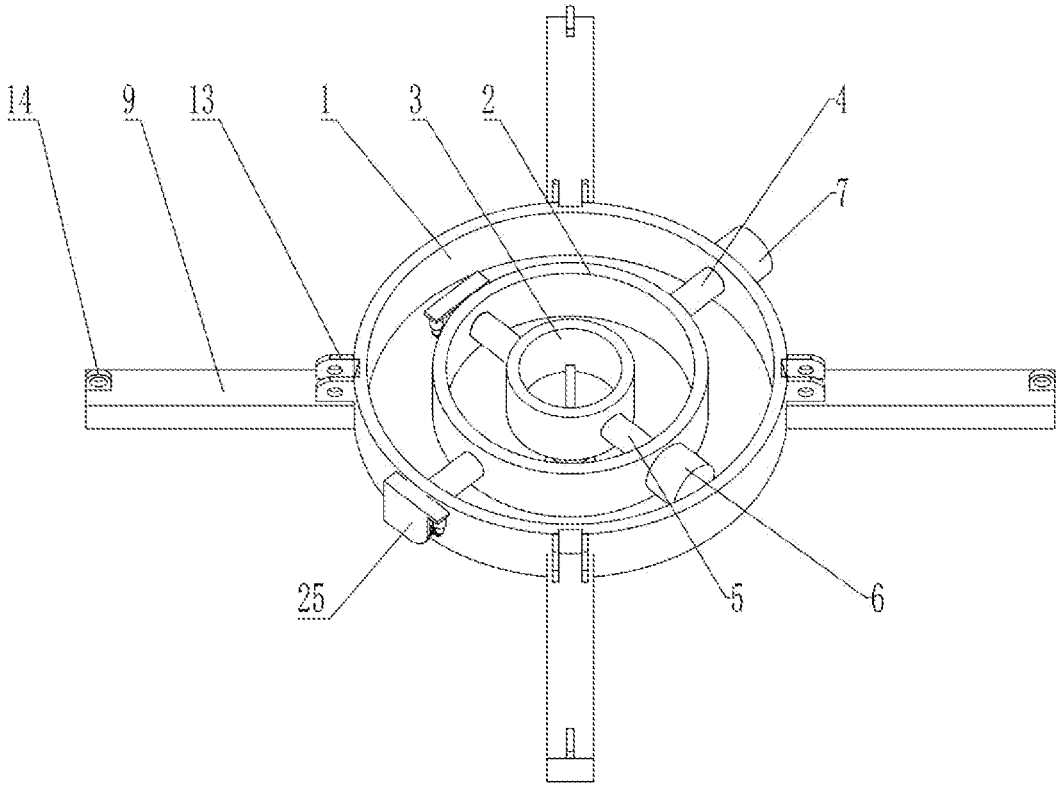
FIG. 3 is a schematic structural diagram of a bottom surface of an outer supporting ring seat of the present application.
Figure 4:
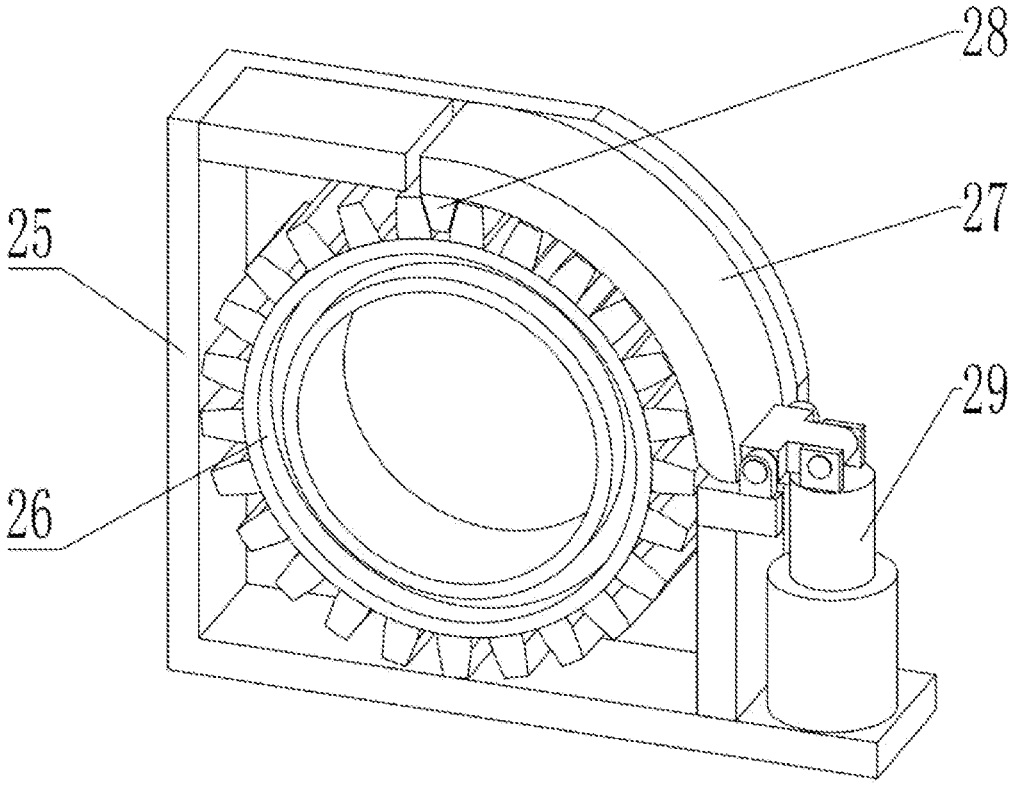
FIG. 4 is a schematic structural diagram of a first locking mechanism or a second locking mechanism of the present application.
Figure 5:
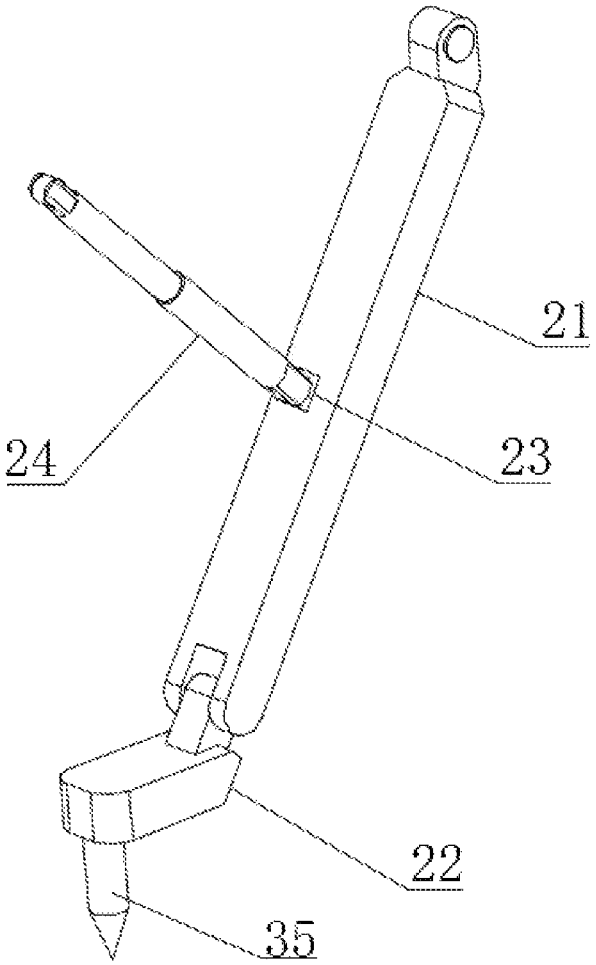
FIG. 5 is a schematic structural diagram of a bottom supporting mechanism of the present application.
Figure 6:
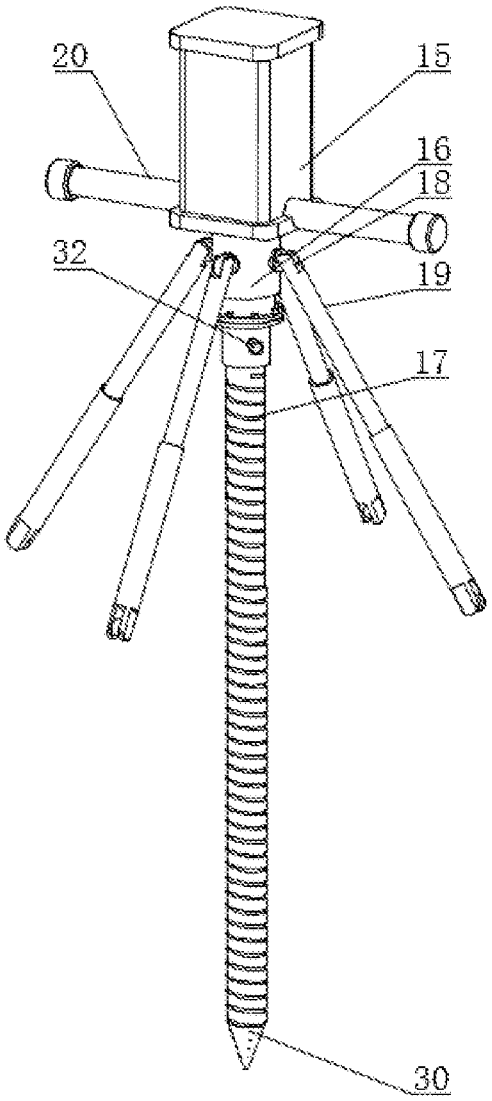
FIG. 6 is a schematic structural diagram of a buffer mechanism of the present application.
Figure 7:
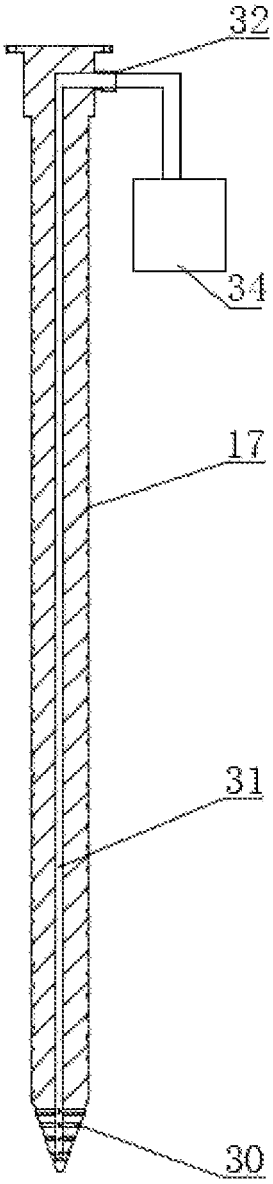
FIG. 7 is a side cross-sectional view of a drill pipe of the present application.
Figure 8:
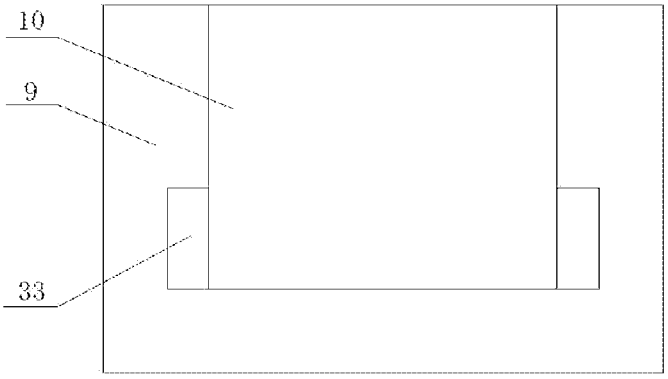
FIG. 8 is a diagram showing a positional relationship between the damping sliding shaft and a slider.

With reference to FIG. 1-FIG. 2, through arranging the damping sliding shaft 33 between the slider 10 and the chute 12, the sliding trend more matches with the sliding speed in drilling process, and the missing of the supporting effect due to too rapid sliding speed is avoided.

With reference to FIG. 1-FIG. 5, the bottom supporting mechanism includes mounting support seats 13 arranged on a bottom surface of each joint of the each of the side supporting arms 9 and the outer supporting ring seat 1. A bottom end of each of the mounting support seats 13 is rotatably connected with a movable leg 21, a bottom end of the movable leg 21 are rotatably connected with a grounding leg 22, and a bottom surface of the grounding leg 22 is provided with a fixing nail 35, so that fixed connection with the ground in multi-height and multi-angle is realized.

With reference to FIG. 1-FIG. 5, through arranging a top connecting seat 14 fixedly welded at one end of a bottom surface of the each of the side supporting arms 9 away from the inner supporting ring seat 3, a bottom connecting seat 23 fixedly welded at a center of a top surface of the movable leg 21, and a buffering hydraulic rod 24 arranged between the bottom connecting seat 23 and the top connecting seat 14, where one end of the buffering hydraulic rod 24 is rotatably connected to the bottom connecting seat 23, and an other end of the buffering hydraulic rod 24 is rotatably connected to the top connecting seat 14, a stable triangular support structure is formed to provide stable support for the drilling device for geotechnical engineering investigation with higher support strength, and the buffering hydraulic rod 24 is utilized to buffer the drilling impact force.

With reference to FIG. 1-FIG. 4, the first locking mechanism and the second locking mechanism both include supporting shells 25 fixedly installed on the outer surface of the outer supporting ring seat 1 and an outer surface of the middle supporting ring seat 2; brake gears 26 are arranged in the supporting shells 25. Two brake gears 26 are fixedly sleeved ends of the first supporting shaft rod 4 and the second supporting shaft rod 5 respectively and a brake strut 27 is rotatably connected at one corner of a top end of the each of the supporting shells 25. A brake chuck 28 is arranged adjacently to the top ends of each of the brake gears 26. A brake cylinder 29 is fixedly installed at one end of the each of the supporting shells 25 adjacent to a rotating shaft of the brake strut 27 and a pow output end of the brake cylinder 29 is rotatably connected with a bottom end of the brake strut 27. The brake cylinder 29 is used to push the brake strut 27 to rotate, so that the brake chuck 28 is inserted into or separated from the clamping groove on the surface of the brake gears 26, thereby realizing the rotation locking of the first supporting shaft rod 4 and the second supporting shaft rod 5.

With reference to FIG. 1-FIG. 7, the drainage mechanism includes water inlet holes 30 arranged on a side of the bottom end of the drill pipe 17 and a drainage hollow groove 31 arranged inside the drill pipe 17, and a water outlet 32 is arranged on a side of a top end of the drill pipe 17, and the water outlet 32 is communicated with the drainage hollow groove 31. The water outlet 32 is connected with a water pumping device 34 through a universal hose. Therefore, the liquid in water layer of rock and soil is discharged upward form the bottom of the drill pipe 17 through the water pumping device 34.

With reference to FIG. 1-FIG. 6, two sides of a bottom end of the drilling drive device 15 are symmetrically provided with handles 20 for conveniently controlling the drilling drive device 15 by the staff.

Usage of the drilling device for geotechnical engineering investigation: firstly, the drilling device for geotechnical engineering investigation is stably connected with the ground through the grounding leg 22 to support the drilling device for geotechnical engineering investigation stably; then, the first supporting shaft rod 4 and the second supporting shaft rod 5 are respectively rotated by the first rotating motor 6 and the second rotating motor 7 according to the drilling needs, so as to drive the drill pipe 17 to rotate in the three-dimensional space until the drill pipe 17 rotates at a proper angle; at the same time, the supporting hydraulic rod 19 at different positions is adaptively retracted and rotated relative to the connecting support seat 16, and the slider 10 at different positions is adaptively rotated inside the chute 12. The drilling drive device 15 and the drill pipe 17 are further provided with adaptive support and buffer, and at the same time, the drilling drive device 15 and the drill pipe 17 are not prevented from rotating in three-dimensional space, so that the inclined drilling to the designated position is carried out.

Secondly, the rotating positions of the first supporting shaft rod 4 and the second supporting shaft rod 5 are locked through the first locking mechanism and the second locking mechanism after the drill pipe 17 is positionally adjusted, thereby avoiding position deviation caused by excessive impact force during drilling, and avoiding damage to the first rotating motor 6 and the second rotating motor 7 at the same time.

Lastly, the drilling drive device 15 drives the drill pipe 17 through the handles 20 to drill the rock and soil layer, and the drill pipe 17 continuously drills into the rock; at the same time, the buffering mechanism changes position adaptively to buffer and support the drill pipe 17 and the drill pipe 17 stops drilling in case of the rock and soil layer. Meanwhile, the water pumping device is communicated with the water outlet 32 and water inside the rock and soil layer is discharged out through the water inlet holes 30 and the drainage hollow groove 31, thereby avoiding affecting the normal drilling.

The above is only the preferred embodiment of the present application, but the protection scope of the present application is not limited to this. Without department from the disclosed technical scope, any equivalent substitutions or modifications made by any technical person who is familiar with the technical field according to the technical scheme and improvement concept thereof should be included in the protection scope of the present application.

What is claimed is:

1. A drilling device for geotechnical engineering investigation, the drilling device comprising: an outer supporting ring seat, wherein a center of the outer supporting ring seat is rotatably connected with a middle supporting ring seat through a first supporting shaft rod; a center of the middle supporting ring seat is rotatably connected with an inner supporting ring seat through a second supporting shaft rod; the first supporting shaft rod and the second supporting shaft rod are vertically crossed; a first rotating motor is fixedly installed on an outer surface of the outer supporting ring seat, a power output end of the first rotating motor is fixedly connected with one end of the first supporting shaft rod, an other end of the first supporting shaft rod is provided with a first locking mechanism for position limitation; a second rotating motor is fixedly installed on an outer surface of the middle supporting ring seat, a power output end of the second rotating motor is fixedly connected with one end of the second supporting shaft rod, and an other end of the second supporting shaft rod is provided with a second locking mechanism for position limitation; a drill pipe limit seat is fixedly installed right above the inner supporting ring seat through a bracket, a drilling drive device is arranged right above the drill pipe limit seat, and a connecting support seat is fixedly installed at a power output end of the drilling drive device; a drill pipe is fixedly installed at a bottom end of the connecting support seat, a bottom end of the drill pipe is rotatably connected inside the drill pipe limit seat, a drainage mechanism for discharging liquid inside rocks is arranged inside the drill pipe; a buffering mechanism for buffering and supporting the drilling drive device is arranged between the connecting support seat and the outer supporting ring seat, and a bottom surface of the outer supporting ring seat is provided with a bottom supporting mechanism fixedly connected with a ground.

2. The drilling device for geotechnical engineering investigation according to claim 1, wherein the buffering mechanism comprises side supporting arms fixedly welded to the outer surface of the outer supporting ring seat and first universal ball shafts rotatably connected to an outer surface of the connecting support seat; a top surface of each of the side supporting arms is provided with a chute; a slider is slidably connected inside the chute; a top surface of the slider is rotatably connected with a second universal ball shaft; a supporting hydraulic rod is arranged between the second universal ball shaft and a corresponding one of the first universal ball shafts; and one end of the supporting hydraulic rod is rotatably connected with the second universal ball shaft and an other end of the supporting hydraulic rod is rotatably connected with the corresponding one of the first universal ball shafts.

3. The drilling device for geotechnical engineering investigation according to claim 2, wherein a number of the side supporting arms is at least four, and the side supporting arms are uniformly circumferentially arrayed on the outer surface of the outer supporting ring seat, and a number of the first universal ball shafts is equal to the number of the side supporting arms, and positions of the first universal ball shafts are in one-to-one correspondence with that of the side supporting arms.

4. The drilling device for geotechnical engineering investigation according to claim 2, wherein a damping sliding shaft is arranged between the slider and the chute.

5. The drilling device for geotechnical engineering investigation according to claim 2, wherein the bottom supporting mechanism comprises a mounting support seat arranged on a bottom surface of a joint between each of the side supporting arms and the outer supporting ring seat, a bottom end of the mounting support seat is rotatably connected with a movable leg, a bottom end of the movable leg is rotatably connected with a grounding leg, and a bottom surface of the grounding leg is provided with a fixing nail.

6. The drilling device for geotechnical engineering investigation according to claim 5, wherein a top connecting seat is fixedly welded at one end of a bottom surface of each of the side supporting arms away from the inner supporting ring seat, a bottom connecting seat is fixedly welded at a center of a top surface of the movable leg, and a buffering hydraulic rod is arranged between the bottom connecting seat and the top connecting seat, wherein one end of the buffering hydraulic rod is rotatably connected to the bottom connecting seat, and an other end of the buffering hydraulic rod is rotatably connected to the top connecting seat.

7. The drilling device for geotechnical engineering investigation according to claim 1, wherein the first locking mechanism and the second locking mechanism comprise supporting shells fixedly installed on the outer surface of the outer supporting ring seat and the outer surface of the middle supporting ring seat respectively; a brake gear is arranged in each of the supporting shells; the brake gear is fixedly sleeved on each of the other end of the first supporting shaft rod and the other end of the second supporting shaft rod; a brake strut is rotatably connected at one corner of a top end of each of the supporting shells; a brake chuck is arranged on a bottom surface of one end of the brake strut adjacent to a top surface of the brake gear; a brake cylinder is fixedly installed at one end of each of the supporting shells adjacent to a rotating shaft of the brake strut; and a power output end of the brake cylinder is rotatably connected with a bottom end of the brake strut.

8. The drilling device for geotechnical engineering investigation according to claim 1, wherein the drainage mechanism comprises water inlet holes arranged on a side of the bottom end of the drill pipe and a drainage hollow groove arranged inside the drill pipe, and a water outlet is arranged on a side of a top end of the drill pipe, and the water outlet is communicated with the drainage hollow groove.

9. The drilling device for geotechnical engineering investigation according to claim 8, wherein the water outlet is connected with a water pumping device through a universal hose.

10. The drilling device for geotechnical engineering investigation according to claim 1, wherein two sides of a bottom end of the drilling drive device are symmetrically provided with handles.

* * * * *